US009997113B2

(12) United States Patent
Park et al.

(10) Patent No.: US 9,997,113 B2
(45) Date of Patent: Jun. 12, 2018

(54) DISPLAY APPARATUS FOR CONTROLLING A LIGHT SOURCE LUMINANCE OF EACH DISPLAY AREA AND METHOD OF DRIVING THE SAME

(71) Applicant: SAMSUNG DISPLAY CO., LTD., Yongin-si, Gyeonggi-Do (KR)

(72) Inventors: Jin-Kyu Park, Yongin-si (KR); Jai-Hyun Koh, Hwaseong-si (KR); Joon-Chul Goh, Hwaseong-si (KR); Seok-Yun Son, Suwon-si (KR); Kuk-Hwan Ahn, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 111 days.

(21) Appl. No.: 15/072,825

(22) Filed: Mar. 17, 2016

(65) Prior Publication Data

US 2017/0069274 A1 Mar. 9, 2017

(30) Foreign Application Priority Data

Sep. 8, 2015 (KR) ..... 10-2015-0127182

(51) Int. Cl.
*G09G 3/36* (2006.01)
*G09G 3/34* (2006.01)

(52) U.S. Cl.
CPC ... *G09G 3/3406* (2013.01); *G09G 2320/0247* (2013.01); *G09G 2320/064* (2013.01); *G09G 2320/0686* (2013.01); *G09G 2360/145* (2013.01)

(58) Field of Classification Search
CPC ..... G09G 3/3406
USPC ..... 345/102
See application file for complete search history.

(56) References Cited

U.S. PATENT DOCUMENTS

2004/0257318 A1* 12/2004 Itoh ..... G09G 3/3406 345/87
2012/0139885 A1* 6/2012 Iwasa ..... G09G 3/3426 345/207
2014/0028731 A1* 1/2014 Igawa ..... G09G 5/10 345/690

FOREIGN PATENT DOCUMENTS

KR 10-2008-0079009 8/2008
KR 10-2014-0013453 2/2014

* cited by examiner

*Primary Examiner* — Long D Pham
(74) *Attorney, Agent, or Firm* — F. Chau & Associates, LLC

(57) ABSTRACT

A display apparatus includes a display panel for displaying an image and that includes a plurality of display areas, a light source part for providing a light to the display panel, a luminance measurer for measuring a luminance of each display area of the display panel and outputting a panel luminance signal of each display area of the display panel, and a light source driver for driving the light source part based on the panel luminance signal to decrease the light source luminance signal of each display area of the display panel when the panel luminance signal of each display area of the display panel increases and to increase the light source luminance signal of each display area of the display panel when the panel luminance signal of each display area of the display panel decreases.

11 Claims, 6 Drawing Sheets

DISPLAY APPARATUS FOR CONTROLLING A LIGHT SOURCE LUMINANCE OF EACH DISPLAY AREA AND METHOD OF DRIVING THE SAME

CROSS-REFERENCE TO RELATED APPLICATIONS

This application claims priority under 35 U.S.C. § 119 from, and the benefit of, Korean Patent Application No. 10-2015-0127182, filed on Sep. 8, 2015 in the Korean Intellectual Property Office KIPO, the contents of which are herein incorporated by reference in their entirety.

BACKGROUND

1. Technical Field

Exemplary embodiments of the present inventive concept are directed to a display apparatus and method of driving the display apparatus. More particularly, exemplary embodiments of the present inventive concept are directed to a display apparatus with improved display quality and a method of driving the display apparatus.

2. Discussion of the Related Art

A display panel of a display apparatus such as a liquid crystal display apparatus or an electrophoretic display apparatus includes a pixel electrode and a common electrode. A pixel voltage is applied to the pixel electrode and a common voltage is applied to the common electrode.

However, the pixel voltage applied to the pixel electrode may leak. Thus, a voltage of the pixel electrode may be a first, pixel voltage and a second voltage lower than the first voltage.

A luminance of the display panel is a first luminance when the pixel electrode has the first voltage, and is a second luminance different from the first luminance when the pixel electrode has the second voltage. Thus, there will be difference between luminances of the display panel when the pixel electrode has the first voltage and when the pixel electrode has the second voltage.

The differences between luminances of the display panel when the pixel electrode has the first voltage and when the pixel electrode has the second voltage change due to a vertical start signal for outputting gate signals to gate lines on the display panel.

Specifically, a luminance difference of the display panel increases as a frequency of the vertical start signal decreases. For example, the luminance difference of the display panel may have a first value when the frequency of the vertical start signal is about 60 hertz (HZ), the luminance difference of the display panel may have a second value greater than the first value when the frequency of the vertical start signal is about 30 HZ, and the luminance difference of the display panel may have a third value greater than the second value when the frequency of the vertical start signal is about 15 HZ.

The luminance difference of the display panel increases as the frequency of the vertical start signal decreases, and thus flicker may appear on the display panel. Thus, a display quality of a display apparatus that includes the display panel is degraded.

SUMMARY

Exemplary embodiments of the present inventive concept provide a display apparatus that decreases flicker.

Exemplary embodiments of the present inventive concept also provide a method of driving a display apparatus.

In an exemplary embodiment of a display apparatus according to the present inventive concept, the display apparatus includes a display panel configured to display an image and that includes a plurality of display areas, a light source part configured to provide a light to the display panel, a luminance measurer configured to measure a luminance of each display area of the display panel and output a panel luminance signal of each display area of the display panel, and a light source driver configured to drive the light source part based on the panel luminance signal to decrease the light source luminance signal of each display area of the display panel when the panel luminance signal of each display area of the display panel increases and to increase the light source luminance signal of each display area of the display panel when the panel luminance signal of each display area of the display panel decreases.

In an exemplary embodiment, the display apparatus further includes a timing controller configured to receive the panel luminance signal of each display area of the display panel and to output a dimming signal to the light source driver for controlling a luminance of each display area of the display panel.

In an exemplary embodiment, the dimming signal is a digital signal. The light source driver includes a digital/analog converter that converts the dimming signal to an analog dimming signal and outputs the analog dimming signal, and a light source driving signal generator configured to convert the analog dimming signal into a light source driving signal and to output the light source driving signal to the light source part.

In an exemplary embodiment, the digital/analog converter includes a switch that receives the dimming signal, a first resistor that is selectively connected to the switch by the dimming signal and that has a first resistance, a second resistor that is selectively connected to the switch by the dimming signal and that has a second resistance different from the first resistance, and a capacitor that is selectively connected with the first resistor or the second resistor through the switch.

In an exemplary embodiment, the display panel is in a normal white mode. The panel luminance signal has a first level when a first voltage is applied to a pixel electrode of the display panel, the panel luminance signal has a second level higher than the first level when a second voltage lower than the first voltage is applied to the pixel electrode of the display panel. The light source luminance signal has a third level when the panel luminance signal has the first level, and the light source luminance signal has a fourth level lower than the third level when the panel luminance signal has the second level. A difference between the first level and the second level may be substantially the same as a difference between the third level and the fourth level.

In an exemplary embodiment, the display panel is in a normal black mode. The panel luminance signal has a fifth level when a first voltage is applied to a pixel electrode of the display panel, the panel luminance signal has a sixth level lower than the fifth level when a second voltage lower than the first voltage is applied to the pixel electrode of the display panel. The light source luminance signal has a seventh level when the panel luminance signal has the fifth level, and the light source luminance signal has an eighth level higher than the seventh level when the panel luminance signal has the sixth level. A difference between the fifth level and the sixth level may be substantially the same as a difference between the seventh level and the eighth level.

In an exemplary embodiment, the display panel displays an image in response to a vertical start signal that has a first period, and the first period includes a scanning period during which a frame of image data displayed by the display panel is scanned and a standby period during which the frame of image data is not scanned.

In an exemplary embodiment, wherein a waveform of the panel luminance signal and a waveform of the light source luminance signal have portions symmetric to each other.

In an exemplary embodiment of a method of driving a display apparatus, the method includes dividing a display panel into a plurality of display areas, measuring a luminance of each display area of the display panel and outputting a panel luminance signal indicative of the luminance of each display area of the display panel, outputting a light source driving signal based on the panel luminance signal, wherein the light source driving signal is configured to drive the light source part to decrease the light source luminance signal of each display area of the display panel when the panel luminance signal of each display area of the display panel increases and to increase the light source luminance signal of each display area of the display panel when the panel luminance signal of each display area of the display panel decreases and driving the light source part in response to the light source driving signal.

In an exemplary embodiment, the method further includes receiving the panel luminance signal of each display area of the display panel to generate and output to the light source part a dimming signal for controlling a luminance of each display area of the display panel.

In an exemplary embodiment, the dimming signal is a digital signal, and the display apparatus includes a light source driver configured to drive the light source part. The light source driver includes a digital/analog converter that converts the dimming signal into an analog dimming signal and outputs the analog dimming signal, a light source driving signal generator configured to convert the analog dimming signal into the light source driving signal and to output the light source driving signal to the light source part In an exemplary embodiment, the digital/analog converting part includes a switch that receives the dimming signal, a first resistor that is selectively connected to the switch by the dimming signal and that has a first resistance, a second resistor that is selectively connected to the switch by the dimming signal and that has a second resistance different from the first resistance, and a capacitor that is selectively connected with the first resistor or the second resistor through the switch.

In an exemplary embodiment, the display panel is in a normal white mode. The panel luminance signal has a first level when a first voltage is applied to a pixel electrode of the display panel, the panel luminance signal has a second level higher than the first level when a second voltage lower than the first voltage is applied to the pixel electrode of the display panel. The light source luminance signal has a third level when the panel luminance signal has the first level, and the light source luminance signal has a fourth level lower than the third level when the panel luminance signal has the second level. A difference between the first level and the second level may be substantially the same as a difference between the third level and the fourth level.

In an exemplary embodiment, the display panel is in a normal black mode. The panel luminance signal has a fifth level when a first voltage is applied to a pixel electrode of the display panel, the panel luminance signal has a sixth level lower than the fifth level when a second voltage lower than the first voltage is applied to the pixel electrode of the display panel. The light source luminance signal has a seventh level when the panel luminance signal has the fifth level, and the light source luminance signal has an eighth level higher than the seventh level when the panel luminance signal has the sixth level. A difference between the fifth level and the sixth level may be substantially the same as a difference between the seventh level and the eighth level.

In an exemplary embodiment, the display panel displays an image in response to a vertical start signal that has a first period. The first period includes a scanning period during which a frame of an image data displayed by the display panel is scanned and a standby period during which the frame of the image data is not scanned.

In an exemplary embodiment, a waveform of the panel luminance signal and a waveform of the light source luminance signal have portions symmetric to each other.

In an exemplary embodiment of a display apparatus according to the present inventive concept, the display apparatus includes a luminance measurer configured to measure a luminance of each of a plurality of display area of a display panel and output a panel luminance signal of each display area of the display panel, a timing controller configured to receive the panel luminance signal of each display area of the display panel and to output a dimming signal for controlling a luminance of each display area of the display panel, and a light source driver configured to drive the light source part based on the dimming signal received from the timing controller to generate a light source luminance signal, wherein the light source luminance signal of each display area of the display panel decreases when the panel luminance signal of each display area of the display panel increases and the light source luminance signal of each display area of the display panel increases when the panel luminance signal of each display area of the display panel decreases.

In an exemplary embodiment, the display apparatus includes a display panel configured to display an image and that comprises the plurality of display areas, and a light source part configured to provide light to the display panel.

In an exemplary embodiment, the display panel is in a normal white mode, and the panel luminance signal has a first level when a first voltage is applied to a pixel electrode of the display panel, the panel luminance signal has a second level higher than the first level when a second voltage lower than the first voltage is applied to the pixel electrode of the display panel, and the light source luminance signal has a third level when the panel luminance signal has the first level, the light source luminance signal has a fourth level lower than the third level when the panel luminance signal has the second level.

In an exemplary embodiment, the display panel is in a normal black mode, and the panel luminance signal has a fifth level when a first voltage is applied to a pixel electrode of the display panel, the panel luminance signal has a sixth level lower than the fifth level when a second voltage lower than the first voltage is applied to the pixel electrode of the display panel, and the light source luminance signal has a seventh level when the panel luminance signal has the fifth level, the light source luminance signal has an eighth level higher than the seventh level when the panel luminance signal has the sixth level.

According to a present exemplary embodiment, a method of driving a display apparatus divides a display panel into a plurality of display areas, and then compensates luminance of each area of the display panel independently. Since a proper dimming compensation is performed for each display area of the display panel, a proper dimming compensation can be performed for all areas of the display panel.

DETAILED DESCRIPTION OF EXEMPLARY EMBODIMENTS

Hereinafter, exemplary embodiments of the present inventive concept will be explained in detail with reference to the accompanying drawings. Herein, when two or more elements are described as being substantially the same as each other, it is to be understood that the elements are identical to each other, indistinguishable from each other, or distinguishable from each other but functionally the same as each other as would be understood by a person having ordinary skill in the art.

Figure 1:
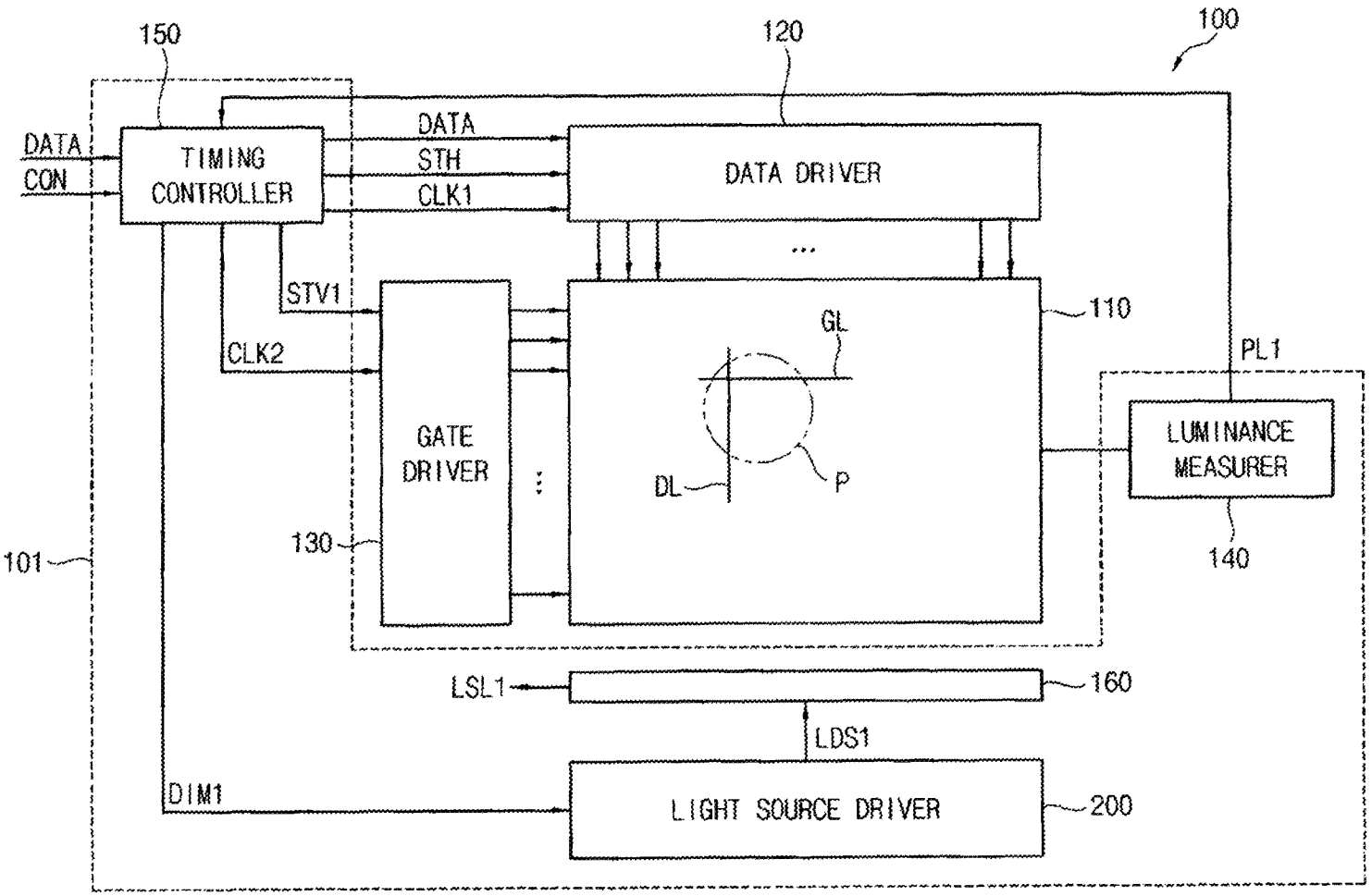
FIG. 1 is a block diagram that illustrates a display apparatus according to an exemplary embodiment of the present inventive concept.

FIG. 1 is a block diagram that illustrates a display apparatus according to an exemplary embodiment of the present inventive concept.

Referring to FIG. 1, a display apparatus 100 according to a present exemplary embodiment includes a display panel 110, a data driver 120, a gate driver 130 and a light source apparatus 101. The light source apparatus 101 includes a luminance measurer 140, a timing controller 150, a light source part 160 and a light source driver 200.

The display panel 110 receives image data DATA to display an image. The display panel 110 includes a plurality of gate lines GL, a plurality of data lines DL and a plurality of pixels P. For example, the display panel 110 may include M×N pixels P, where M and N are each natural numbers. Each of the pixels P includes a thin-film transistor electrically connected to a gate line GL and a data line DL, a liquid crystal capacitor and a storage capacitor connected to the thin-film transistor.

In addition, according to embodiments, the display panel 110 includes a pixel electrode, a common electrode facing the pixel electrode, and a liquid crystal layer interposed between the pixel electrode and the common electrode. In addition, the display panel 110 may normally be in a white mode. Thus, the display panel 110 may be in a full white state when no pixel voltages are applied to the pixel electrode.

The timing controller 150 receives the image data DATA and a control signal CON, both of which are externally supplied. According to an embodiment, the control signal CON includes a horizontal synchronous signal Hsync, a vertical synchronous signal Vsync and a clock signal.

According to an embodiment, the timing controller 150 generates a horizontal start signal STH using the horizontal synchronous signal Hsync and outputs the horizontal start signal STH to the data driver 120. In addition, the timing controller 150 generates a vertical start signal STV1 using the vertical synchronous signal Vsync and outputs the vertical start signal STV1 to the gate driver 130. According to an embodiment, the vertical start signal STV1 has a frequency of about 30 hertz (HZ).

In addition, according to an embodiment, the timing controller 150 generates a first clock signal CLK1 and a second clock signal CLK2 using the clock signal and outputs the first clock signal CLK1 to the data driver 120 and the second clock signal CLK2 to the gate driver 130.

In addition, according to an embodiment, the timing controller 150 outputs a dimming signal DIM1 that controls the luminance of the light source part 160. Specifically, the timing controller 150 receives a panel luminance signal PL1 from the luminance measurer 140 that indicates the luminance of the display panel 110, and outputs the dimming signal DIM1 to the light source driver 200 based on the panel luminance signal PL1 so that a waveform of a light source luminance signal LSL1 that indicates the luminance of the light source part 160 has a phase opposite to that of the waveform of the panel luminance signal PL1.

According to an embodiment, the data driver 120 outputs the image data DATA to the data lines DL in response to the first clock signal CLK1 and the horizontal start signal STH received from the timing controller 150.

According to an embodiment, the gate driver 130 generates gate signals using the vertical start signal STV1 and the second clock signal SLK2 received from the timing controller 150 and outputs the gate signals to the gate lines GL.

According to an embodiment, the luminance measurer 140 measures a luminance of the display panel 110 to output the panel luminance signal PL1 to the timing controller 150.

According to an embodiment, the light source driver 200 receives the dimming signal DIM1 from the timing controller 150, and outputs the light source driving signal LDS1 to the light source part 160 based on the dimming signal DIM1

According to an embodiment, the light source part 160 is driven in response to a light source driving signal LDS1 received from the light source driver 200 and provides light to the display panel 110. The light source part 160 may be disposed at a side of the display panel 110. Alternatively, the light source part 160 may be disposed under the display panel 110. In addition, according to an embodiment, the light source part 160 generates the light source luminance signal LSL1 that indicates the luminance of the light source part 160.

Figure 2:
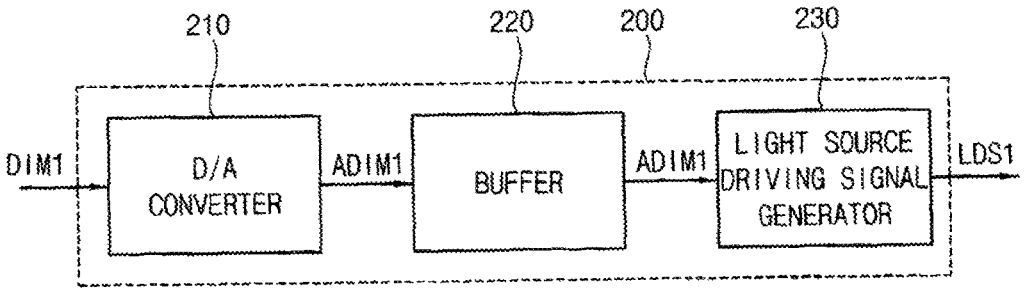
FIG. 2 is a block diagram that illustrates a light source driver of the display apparatus of FIG. 1.

FIG. 2 is a block diagram that illustrates a light source driver of the display apparatus of FIG. 1.

Referring to FIGS. 1 and 2, the light source driver 200 includes a digital/analog converter 210, a buffer 220 and a light source driving signal generator 230.

According to an embodiment, the digital/analog converter 210 receives the dimming signal DIM1 from the timing controller 150. The dimming signal DIM1 is a digital signal. For example, the dimming signal DIM1 may be a pulse width modulated (PWM) signal. The digital/analog converter 210 converts the dimming signal DIM1 to an analog dimming signal ADIM1 and outputs the analog dimming signal ADIM1. The analog dimming signal ADIM1 may be a voltage signal. The buffer 220 buffers the analog dimming signal ADIM1.

According to an embodiment, the light source driving signal generator 230 receives the analog dimming signal ADIM1, converts the analog dimming signal ADIM1 to the light source driving signal LDS1 and outputs the light source driving signal LDS1 to the light source part 160. The light source driving signal LDS1 may be a current signal.

Figure 3:
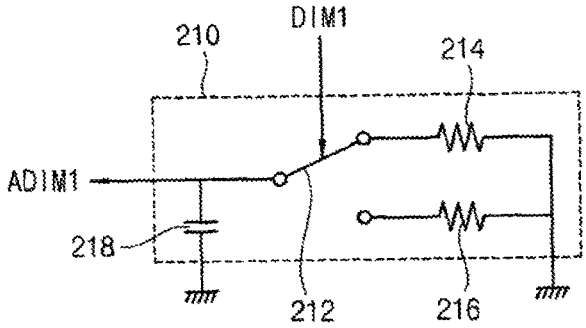
FIG. 3 is a block diagram that illustrates a digital/analog converter of the light source driver of FIG. 2.

FIG. 3 is a block diagram that illustrates a digital/analog converter of the light source driver of FIG. 2.

Referring to FIGS. 2 and 3, the digital/analog converter 210 includes a switch 212, a first resistor 214, a second resistor 216 and a capacitor 218.

According to an embodiment, a first resistance of the first resistor 214 differs from a second resistance of the second resistor 216. For example, the first resistance of the first resistor 214 may be greater than the second resistance of the second resistor 216. Alternatively, the first resistance of the first resistor 214 may be less than the second resistance of the second resistor 216.

According to an embodiment, the switch 212 electrically connects the capacitor 218 with the first resistor 214 or with the second resistor 216 in response to the dimming signal DIM1. Thus, the capacitor 218 is selectively connected with the first resistor 214 or the second resistor 216.

A level of the analog dimming signal ADIM1 when the capacitor 218 is electrically connected with the first resistor 214 differs from a level of the analog dimming signal ADIM1 when the capacitor 218 is electrically connected with the second resistor 216. Thus, the analog dimming signal ADIM1 output by the digital/analog converter 210 changes levels in response to the dimming signal DIM1.

Figure 4:
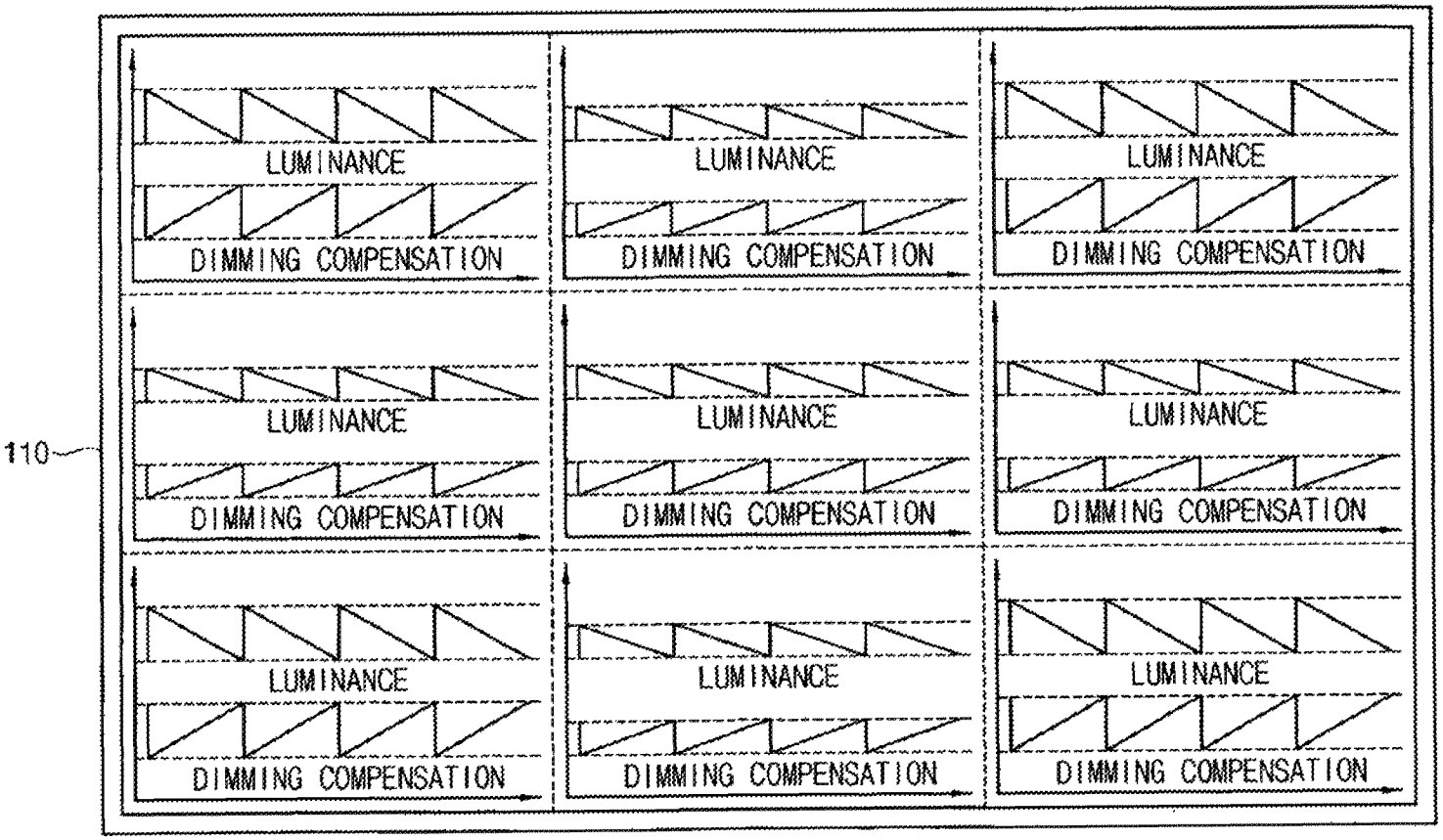
FIG. 4 illustrates dimming compensation based on a plurality of display areas of a display panel according to an exemplary embodiment of the present inventive concept.

FIG. 4 illustrates dimming compensation based on a plurality of display areas of a display panel according to an exemplary embodiment of the present inventive concept.

Referring to FIG. 4, a method of driving a display apparatus according to an exemplary embodiment of the present inventive concept divides a display panel into a plurality of display areas, and then outputs a light source driving signal to drive the light source part based on the panel luminance signal to decrease the light source luminance signal of each display area when the panel luminance signal of each display area increases and to increase the light source luminance signal of each display area when the panel luminance signal of each display area decreases.

According to an embodiment, the display panel 110 is divided into a plurality of display areas. Each display area of the display panel displays an image with different luminance. Thus, the luminance changes of each display area may differ.

A method of driving a display apparatus according to an exemplary embodiment of the present inventive concept can calculate a degree of flicker for each display area of the display panel, and then perform a proper dimming compensation for each display area of the display panel.

According to an embodiment, the light source luminance signal of each display area decreases when the panel luminance signal of each display area increases. In addition, the light source luminance signal of each display area increases when the panel luminance signal of each display area decreases.

Thus, a waveform of the panel luminance signal of each display area of the display panel 110 and a waveform of the light source luminance signal have portions that are symmetric.

According to an embodiment, luminance change values of left-right areas of the display panel are relatively greater than luminance change values of center areas of the display panel. Thus, when dimming compensation is performed based on a luminance signal of the center areas of the display panel, a proper dimming compensation for left-right areas of the display panel may not be performed.

In general, flicker of the left-right areas of the display panel is greater than flicker of the center areas of the display panel. In addition, each display area of the display panel may display an image with different luminance. Thus, when a uniform dimming compensation is performed for all areas of the display panel, a proper dimming compensation is not performed for all areas of the display panel.

However, a method of driving a display apparatus according to an exemplary embodiment of the present inventive concept divides a display panel into a plurality of display areas, and compensates luminance in each area of the display panel independently. Since a method performs a proper dimming compensation for each display area of the display panel, a proper dimming compensation for all areas of the display panel can be performed.

Figure 5:
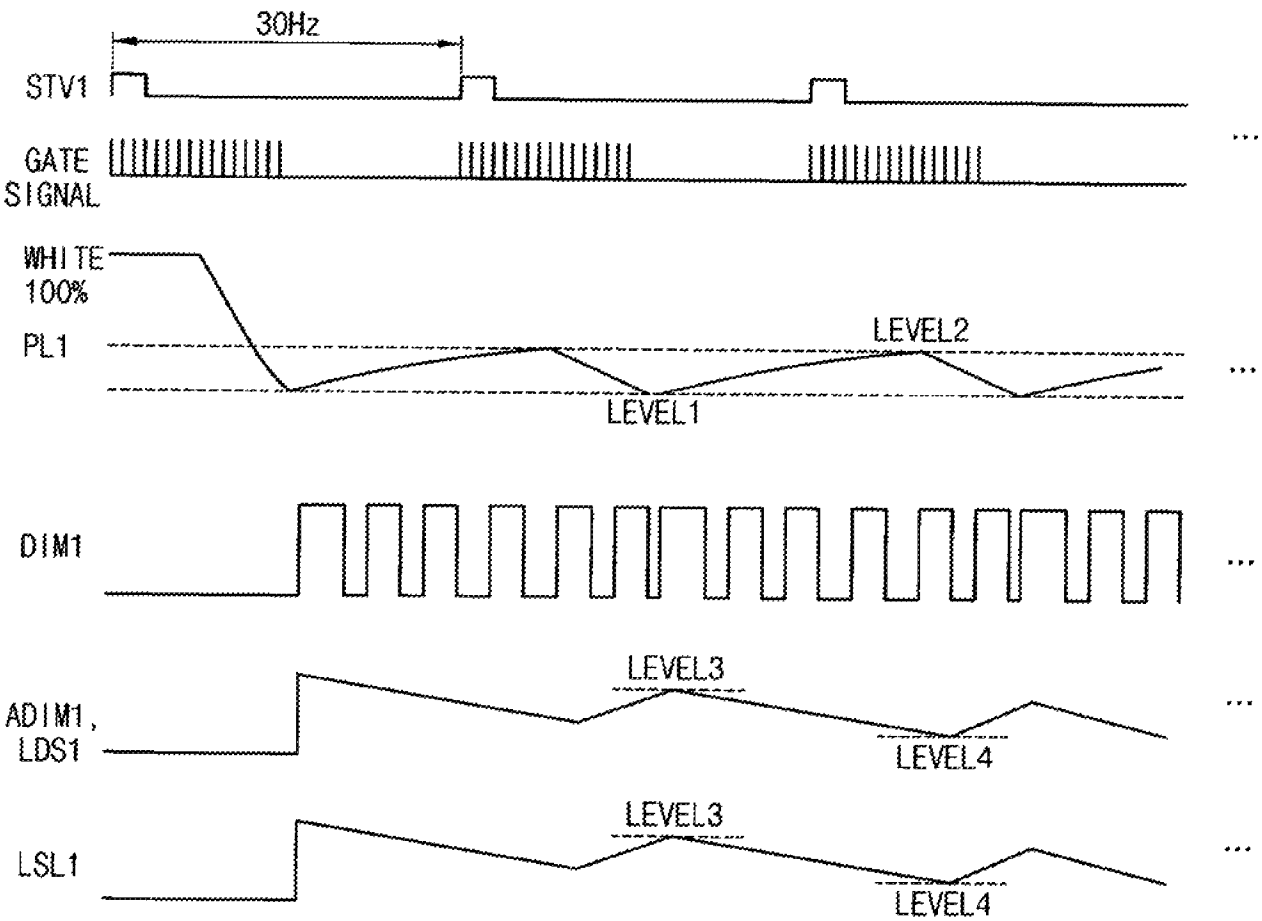
FIG. 5 is a waveform diagram of a vertical start signal, a panel luminance signal, a dimming signal, an analog dimming signal, a light source driving signal and a light source luminance signal of one display area of a display panel according to an exemplary embodiment of the present inventive concept.

FIG. 5 is a waveform diagram of a vertical start signal, a panel luminance signal, a dimming signal, an analog dimming signal, a light source driving signal and a light source luminance signal of one display area of a display panel according to an exemplary embodiment of the present inventive concept.

Referring to FIGS. 1 to 5, the vertical start signal STV1 has a first period which includes a scanning period in which a frame of the image data DATA displayed by the display panel 110 is scanned and a standby period in which the frame of the image data DATA is not scanned. For example, the vertical start signal STV1 may have the frequency of about 30 Hz, and the frame of the image data DATA may have a frequency of about 60 Hz. Thus, the gate signals are applied to the gate lines GL during a half period between the vertical starts signals STV1. FIG. 5 illustrates a vertical start signal, a panel luminance signal, a dimming signal, an analog dimming signal, a light source driving signal and a light source luminance signal of one display area of a display panel when the display panel 110 is in a normal white mode.

According to an embodiment, the display panel 110 is in a normal white mode. Thus, the panel luminance signal PL1 has a first level LEVEL1 when a first voltage is applied to the pixel electrode of the display panel 110 and a second level LEVEL2 higher than the first level LEVEL1 when a second voltage lower than the first voltage is applied to the pixel electrode of the display panel 110. For example, the first voltage may be a pixel voltage and the second voltage may be due to leakage from the pixel voltage.

The waveform of the light source luminance signal LSL1 indicating the luminance of the light source part 160 is opposite to, i.e., out of phase with, the waveform of the panel luminance signal PL1. Specifically, the light source luminance signal LSL1 decreases as the panel luminance signal PL1 increases, and increases as the panel luminance signal PL1 decreases. Thus, the light source luminance signal LSL1 has a third level LEVEL3 when the panel luminance signal PL1 has the first level LEVEL1 and a fourth level LEVEL4 lower than the third level LEVEL3 when the panel luminance signal PL1 has the second level LEVEL2 higher than the first level LEVEL1.

According to an embodiment, the light source driving signal LDS1 and the analog dimming signal ADIM1 are signals for driving the light source part 160, and thus the waveforms of each of the light source driving signal LDS1 and the analog dimming signal ADIM1 are substantially similar to the waveform of the light source luminance signal LSL1. Thus, each of the light source driving signal LDS1 and the analog dimming signal ADIM1 has the third level LEVEL3 when the panel luminance signal PL1 has the first level LEVEL1 and the fourth level LEVEL4 lower than the third level LEVEL3 when the panel luminance signal PL1 has the second level LEVEL2 higher than the first level LEVEL1.

According to an embodiment, the waveforms of each of the light source driving signal LDS1, the analog diming signal ADIM1 and the light source luminance signal LSL1 is out of phase with and opposite to the waveform of the panel luminance signal PL1, and thus the waveforms of each of the light source driving signal LDS1, the analog diming signal ADIM1 and the light source luminance signal LSL1 has portions symmetric with the waveform of the panel luminance signal PL1. Thus, a difference between the first level LEVEL1 and the second level LEVEL2 of the panel luminance signal PL1 is substantially the same as a difference between the third level LEVEL3 and the fourth level LEVEL4 of the light source driving signal LDS1, the analog diming signal ADIM1 and the light source luminance signal LSL1.

A low level period of the dimming signal DIM1 increases and a high level period of the dimming signal DIM1 decreases to decrease the analog dimming signal ADIM1 as the panel luminance signal PL1 increases, and the low level period of the dimming signal DIM1 decreases and the high level period of the dimming signal DIM1 increases to increase the analog dimming signal ADIM1 as the panel luminance signal PL1 decreases.

The waveform diagram in FIG. 5 of a vertical start signal, a panel luminance signal, a dimming signal, an analog dimming signal, a light source driving signal and a light source luminance signal of one display area of a display panel is applicable to each display area of a display panel. That is, the luminance of each area of the display panel can be compensated by the same method.

A method of driving a display apparatus according to an exemplary embodiment of the present inventive concept divides a display panel into a plurality of display areas, and compensates luminance of each area of the display panel. Since a proper dimming compensation is performed for each display area of the display panel, a proper dimming compensation can be performed for all areas of the display panel.

Figure 6:
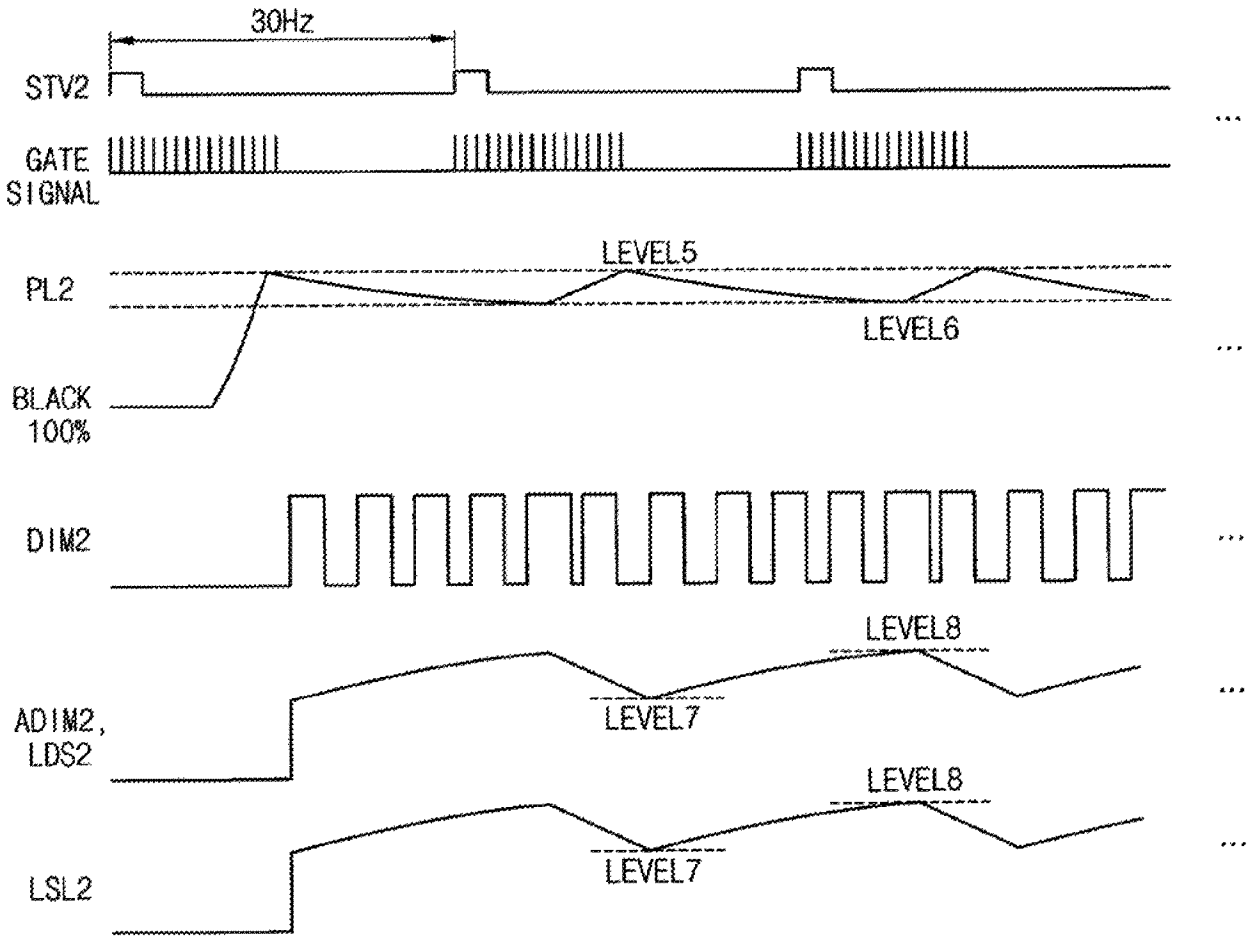
FIG. 6 is a waveform diagram of a vertical start signal, a panel luminance signal, a dimming signal, an analog dimming signal, a light source driving signal and a light source luminance signal of one display area of a display panel according to an exemplary embodiment of the present inventive concept.

FIG. 6 is a waveform diagram of a vertical start signal, a panel luminance signal, a dimming signal, an analog dimming signal, a light source driving signal and a light source luminance signal of one display area of a display panel according to an exemplary embodiment of the present inventive concept.

Referring to FIGS. 1 to 4 and FIG. 6, according to an embodiment, the vertical start signal STV2 has a frequency of about 30 Hz, and a frame of the image data DATA has a frequency of about 60 Hz. Thus, gate signals are applied to the gate lines GL during a half period between the vertical start signals STV2. FIG. 6 illustrates a vertical start signal, a panel luminance signal, a dimming signal, an analog dimming signal, a light source driving signal and a light source luminance signal of one display area of a display panel when the display panel 110 is in a normal black mode.

According to an embodiment, the display panel 110 is in a normal black mode. Thus, the panel luminance signal PL2 has a fifth level LEVEL5 when a first voltage is applied to the pixel electrode of the display panel 110 and a sixth level LEVEL6 lower than the fifth level LEVEL5 when a second voltage lower than the first voltage is applied to the pixel electrode of the display panel 210. For example, the first voltage may be a pixel voltage and the second voltage may be due to leakage from the pixel voltage.

According to an embodiment, the waveform of the light source luminance signal LSL2 indicating the luminance of the light source part 160 is out of phase with and opposite to the waveform of the panel luminance signal PL2. Specifically, the light source luminance signal LSL2 decreases as the panel luminance signal PL2 increases, and increases as the panel luminance signal PL2 decreases. Thus, the light source luminance signal LSL2 has a seventh level LEVEL7 when the panel luminance signal PL2 has the fifth level LEVEL5, and an eighth level LEVEL8 higher than the seventh level LEVEL7 when the panel luminance signal PL2 has the sixth level LEVEL6 lower than the fifth level LEVEL5.

According to an embodiment, the light source driving signal LDS2 and the analog dimming signal ADIM2 are signals for driving the light source part 160, and thus the waveforms of each of the light source driving signal LDS2 and the analog dimming signal ADIM2 is substantially similar to the waveform of the light source luminance signal LSL2. Thus, each of the light source driving signal LDS2 and the analog dimming signal ADIM2 has the seventh level LEVEL7 when the panel luminance signal PL2 has the fifth level LEVEL5, and the eighth level LEVEL8 higher than the seventh level LEVEL7 when the panel luminance signal PL2 has the sixth level LEVEL6 lower than the fifth level LEVEL5.

According to an embodiment, the waveforms of each of the light source driving signal LDS2, the analog diming signal ADIM2 and the light source luminance signal LSL2 is opposite to and out of phase with the waveform of the panel luminance signal PL2, and thus the waveforms of each of the light source driving signal LDS2, the analog diming signal ADIM2 and the light source luminance signal LSL2 has portions symmetric with the waveform of the panel luminance signal PL2. Thus, a difference between the fifth level LEVEL5 and the sixth level LEVEL6 of the panel luminance signal PL2 is substantially the same as a difference between the seventh level LEVEL7 and the eighth level LEVEL8 of the light source driving signal LDS2, the analog diming signal ADIM2 and the light source luminance signal LSL2.

A high level period of the dimming signal DIM2 increases and a low level period of the dimming signal DIM2 decreases to increase the analog dimming signal ADIM2 as the panel luminance signal PL2 decreases, and the high level period of the dimming signal DIM2 decreases and the low level period of the dimming signal DIM2 increases to decrease the analog dimming signal ADIM2 as the panel luminance signal PL2 increases.

The waveform diagram in FIG. 5 of a vertical start signal, a panel luminance signal, a dimming signal, an analog dimming signal, a light source driving signal and a light source luminance signal of one display area of a display panel is applicable to each display area of a display panel. That is, the luminance of each area of the display panel can be compensated by the same method.

A method of driving a display apparatus according to an exemplary embodiment of the present inventive concept divides a display panel into a plurality of display areas, and compensates luminance of each area of the display panel. Since a proper dimming compensation is performed for each display area of the display panel, a proper dimming compensation can be performed for all areas of the display panel.

Figure 7:
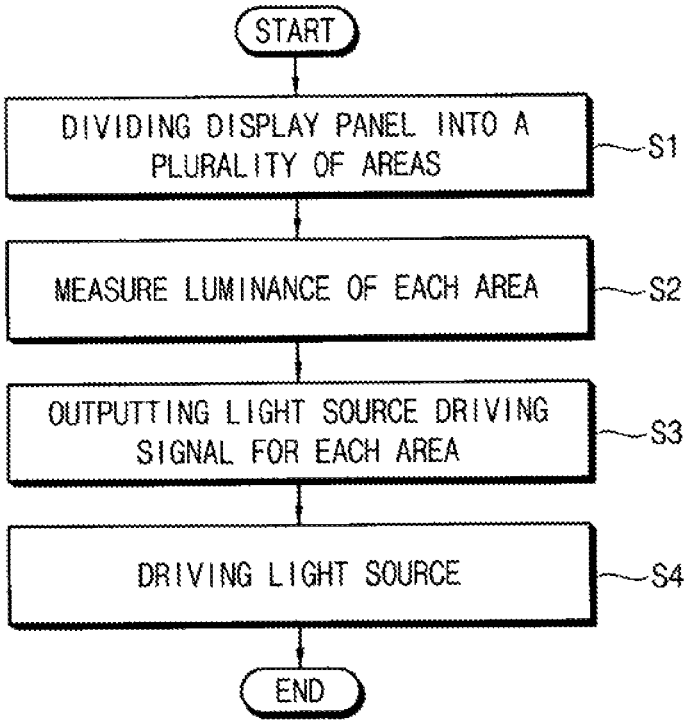
FIG. 7 is a flow chart of a method of driving a display apparatus according to an exemplary embodiment of the present inventive concept.

FIG. 7 is a flow chart of a method of driving a display apparatus according to an exemplary embodiment of the present inventive concept.

Referring to FIGS. 1 to 7, a method of driving a display apparatus according to an exemplary embodiment of the present inventive concept includes dividing a display panel into a plurality of display areas S1, measuring a luminance of each display area of the display panel to output a panel luminance signal for each display area of the display panel S2, outputting a light source driving signal to drive the light source part based on the panel luminance signal S3 so that the light source luminance signal of each display area of the display panel decreases when the panel luminance signal of each display area of the display panel increases, and increases when the panel luminance signal of each display area of the display panel decreases, and driving the light source part in response to the light source driving signal S4.

According to an embodiment, each display area of the display panel can display an image with different luminance. Thus, proper dimming compensation for each display area can be performed when a display panel is divided into a plurality of display areas.

In a process of measuring luminance of each display area of the display panel and outputting a panel luminance signal of each display area of the display panel S2, the panel luminance signal PL1 indicating the luminance of the display panel 110 is output by the luminance measurer 140.

In the process of outputting a light source driving signal to drive the light source part based on the panel luminance signal S3 so that the light source luminance signal of each display area of the display panel decreases when the panel luminance signal of each display area of the display panel increases, and increases when the panel luminance signal of each display area of the display panel decreases, the light source driving signal LDS1 for compensating luminance of the display panel is output based on the panel luminance signal PL1.

According to an embodiment, the light source driving signal LDS1 includes data to decrease the light source luminance signal of each display area of the display panel when the panel luminance signal of each display area of the display panel increases and to increase the light source luminance signal of each display area of the display panel when the panel luminance signal of each display area of the display panel decreases.

In a process of driving the light source part in response to the light source driving signal S4, the light source part 160 is driven in response to the light source driving signal LDS1. For example, the light source part 160 may include an LED disposed under the display panel 110.

According to a present exemplary embodiment, a method of driving a display apparatus divides a display panel into a plurality of display areas, and then compensates luminance of each area of the display panel independently. Since a proper dimming compensation is performed for each display area of the display panel, a proper dimming compensation can be performed for all areas of the display panel.

The foregoing is illustrative of embodiments of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings of embodiments of the present inventive concept. Accordingly, all such modifications are intended to be included within the scope of embodiments of the present inventive concept as defined in the claims. Therefore, it is to be understood that the foregoing is illustrative of embodiments of the present inventive concept and is not to be construed as limited to the specific exemplary embodiments disclosed, and that modifications to the disclosed exemplary embodiments, as well as other exemplary embodiments, are intended to be included within the scope of the appended claims. Embodiments of the present inventive concept are defined by the following claims, with equivalents of the claims to be included therein.

What is claimed is:

1. A display apparatus comprising:

a display panel configured to display an image and comprising a plurality of display areas;

a light source part configured to provide light to the display panel;

a luminance measurer configured to measure a luminance of each display area of the display panel and output a panel luminance signal of each display area of the display panel;

a light source driver configured to drive the light source part based on the panel luminance signal to decrease the light source luminance signal of each display area of the display panel when the panel luminance signal of each display area of the display panel increases and to increase the light source luminance signal of each display area of the display panel when the panel luminance signal of each display area of the display panel decreases; and a timing controller configured to receive the panel luminance signal of each display area of the display panel and to output a dimming signal to the light source driver for controlling a luminance of each display area of the display panel, wherein the dimming signal is a digital signal, wherein the light source driver comprises a digital/analog converter that converts the dimming signal to an analog dimming signal and outputs the analog dimming signal, wherein the digital/analog converter comprises:

a switch that receives the dimming signal;

a first resistor that is selectively connected to the switch by the dimming signal and that has a first resistance;

a second resistor that is selectively connected to the switch by the dimming signal and that has a second resistance different from the first resistance; and a capacitor that is selectively connected with the first resistor or the second resistor through the switch.

2. The display apparatus of claim 1, wherein the dimming signal is a digital signal, and the light source driver further comprises a light source driving signal generator configured to convert the analog dimming signal into a light source driving signal and to output the light source driving signal to the light source part.

3. The display apparatus of claim 1, wherein the display panel is in a normal white mode, and the panel luminance signal has a first level when a first voltage is applied to a pixel electrode of the display panel, the panel luminance signal has a second level higher than the first level when a second voltage lower than the first voltage is applied to the pixel electrode of the display panel, and the light source luminance signal has a third level when the panel luminance signal has the first level, the light source luminance signal has a fourth level lower than the third level when the panel luminance signal has the second level, wherein a difference between the first level and the second level is substantially the same as a difference between the third level and the fourth level.

4. The display apparatus of claim 1, wherein the display panel is in a normal black mode, and the panel luminance signal has a fifth level when a first voltage is applied to a pixel electrode of the display panel, the panel luminance signal has a sixth level lower than the fifth level when a second voltage lower than the first voltage is applied to the pixel electrode of the display panel, and the light source luminance signal has a seventh level when the panel luminance signal has the fifth level, the light source luminance signal has an eighth level higher than the seventh level when the panel luminance signal has the sixth level, wherein a difference between the fifth level and the sixth level is substantially the same as a difference between the seventh level and the eighth level.

5. The display apparatus of claim 1, wherein the display panel displays an image in response to a vertical start signal that has a first period, and the first period includes a scanning period during which a frame of image data displayed by the display panel is scanned and a standby period during which the frame of image data is not scanned.

6. The display apparatus of claim 1, wherein a waveform of the panel luminance signal and a waveform of the light source luminance signal have portions symmetric to each other.

7. A method of driving a display apparatus, the method comprising:

dividing a display panel into a plurality of display areas;

measuring a luminance of each display area of the display panel and outputting a panel luminance signal indicative of the luminance of each display area of the display panel;

receiving the panel luminance signal of each display area of the display panel to generate and output to a light source part a dimming signal for controlling a luminance of each display area of the display panel wherein the dimming signal is a digital signal, converting, by a digital/analog converter, the dimming signal into an analog dimming signal;

converting the analog dimming signal into a light source driving signal; and driving the light source part in response to the light source driving signal, wherein driving the light source part includes decreasing the light source luminance signal of each display area of the display panel when the panel luminance signal of each display area of the display panel increases, and increasing the light source luminance signal of each display area of the display panel when the panel luminance signal of each display area of the display panel decreases, and wherein the digital/analog converter comprises:

a switch that receives the dimming signal;

a first resistor that is selectively connected to the switch by the dimming signal and that has a first resistance;

a second resistor that is selectively connected to the switch by the dimming signal and that has a second resistance different from the first resistance; and a capacitor that is selectively connected with the first resistor or the second resistor through the switch.

8. The method of claim 7, wherein the display panel is in a normal white mode, and the panel luminance signal has a first level when a first voltage is applied to a pixel electrode of the display panel, the panel luminance signal has a second level higher than the first level when a second voltage lower than the first voltage is applied to the pixel electrode of the display panel, and the light source luminance signal has a third level when the panel luminance signal has the first level, the light source luminance signal has a fourth level lower than the third level when the panel luminance signal has the second level, wherein a difference between the first level and the second level is substantially the same as a difference between the third level and the fourth level.

9. The method of claim 7, wherein the display panel is in a normal black mode, and the panel luminance signal has a fifth level when a first voltage is applied to a pixel electrode of the display panel, the panel luminance signal has a sixth level lower than the fifth level when a second voltage lower than the first voltage is applied to the pixel electrode of the display panel, and the light source luminance signal has a seventh level when the panel luminance signal has the fifth level, the light source luminance signal has an eighth level higher than the seventh level when the panel luminance signal has the sixth level, wherein a difference between the fifth level and the sixth level is substantially the same as a difference between the seventh level and the eighth level.

10. The method of claim 7, wherein the display panel displays an image in response to a vertical start signal that has a first period, and the first period includes a scanning period during which a frame of image data displayed by the display panel is scanned and a standby period during which the frame of image data is not scanned.

11. The method of claim 7, wherein a waveform of the panel luminance signal and a waveform of the light source luminance signal have portions symmetric to each other.

* * * * *